US007671305B2

(12) United States Patent
Chodacki et al.

(10) Patent No.: US 7,671,305 B2
(45) Date of Patent: Mar. 2, 2010

(54) SYSTEMS FOR REGULATING VOLTAGE TO AN ELECTRICAL RESISTANCE IGNITER

(75) Inventors: Thomas A. Chodacki, Stow, MA (US); Kevin C. Solofra, Uxbridge, MA (US); James M. Ralson, Naperville, IL (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 0 days.

(21) Appl. No.: 11/471,271

(22) Filed: Jun. 19, 2006

(65) Prior Publication Data

US 2007/0007278 A1 Jan. 11, 2007

Related U.S. Application Data

(63) Continuation of application No. 10/090,450, filed on Mar. 4, 2002, now Pat. No. 7,148,454.

(51) Int. Cl.
*H05B 1/02* (2006.01)

(52) U.S. Cl. ..... 219/497; 219/263; 219/260; 219/501; 431/66; 361/264

(58) Field of Classification Search ..... 219/497, 219/494, 501, 263, 260, 270; 431/66, 67, 431/258; 361/264–266
See application file for complete search history.

(56) References Cited

U.S. PATENT DOCUMENTS

| | | | | |
|---|---|---|---|---|
| 3,589,846 | A | | 6/1971 | Place et al. |
| 4,265,612 | A | | 5/1981 | Romanelli et al. |
| 4,375,205 | A | | 3/1983 | Green |
| 4,925,386 | A | | 5/1990 | Donnelly et al. |
| 4,935,606 | A | | 6/1990 | Geary |
| 5,416,300 | A | | 5/1995 | Hickl et al. |
| 5,725,368 | A | * | 3/1998 | Arensmeier ..... 431/66 |
| 5,865,612 | A | | 2/1999 | Hill et al. |
| 6,104,008 | A | | 8/2000 | Larson |
| 6,474,979 | B1 | | 11/2002 | Rippelmeyer |
| 6,521,869 | B1 | | 2/2003 | Donnelly et al. |
| 2003/0164368 | A1 | | 9/2003 | Chodacki et al. |
| 2004/0209209 | A1 | | 10/2004 | Chodacki et al. |

FOREIGN PATENT DOCUMENTS

| | | |
|---|---|---|
| JP | 8-296850 | 11/1996 |

* cited by examiner

*Primary Examiner*—Mark H Paschall
(74) *Attorney, Agent, or Firm*—Edwards Angell Palmer & Dodge LLP; Peter F. Corless; Lisa Swiszcz

(57) ABSTRACT

Systems and methods for energizing an electrical resistance igniter are disclosed. The systems and methods determine the line voltage into the system and control the voltage being applied to the electrical resistance igniters so a first voltage is applied initially and for a time period and thereafter a second voltage is applied, the second voltage being the operating voltage for the igniter. The systems and methods decrease the amount of time required to heat-up the electrical resistance igniter to a temperature sufficient to ignite the gas while regulating the output voltage being delivered to the igniters to prevent over voltage damage to the igniters.

17 Claims, 3 Drawing Sheets

SYSTEMS FOR REGULATING VOLTAGE TO AN ELECTRICAL RESISTANCE IGNITER

This application is a continuation of U.S. application Ser. No. 10/090,450 filed Mar. 4, 2002, which is incorporated herein by reference in its entirety.

FIELD OF THE INVENTION

The present invention relates to control systems for fuel burner igniters and more particularly to control systems for electrical resistance-type igniters for fuel burners and methods for controlling the voltage thereto.

BACKGROUND OF THE INVENTION

There are a number of appliances such as cooking ranges and clothes dryers and heating apparatuses such as boilers and furnaces in which a combustible material, such as a combustible hydrocarbon (e.g., propane, natural gas, oil) is mixed with air (i.e., oxygen) and continuously combusted within the appliance or heating apparatus so as to provide a continuous source of heat energy. This continuous source of heat energy is used for example to cook food, heat water to supply a source of running hot water and heat air or water to heat a structure such as a house.

Because this mixture of fuel and air (i.e., fuel/air mixture) does not self-ignite when mixed together, an ignition source must be provided to initiate the combustion process and to continue operating until the combustion process is self-sustaining. In the not too distant past, the ignition source was what was commonly referred to as a pilot light in which a very small quantity of the combustible material and air was mixed and continuously combusted even while the heating apparatus or appliance was not in operation. For a number of reasons, the use of a pilot light as an ignition source was done away with and an igniter used instead.

An igniter is a device that creates the conditions required for ignition of the fuel/air mixture on demand, including spark-type igniters such as piezoelectric igniters and hot surface-type igniters such as silicon carbide hot surface igniters. Spark-type igniters that produce an electrical spark that ignites gas, advantageously provide very rapid ignition, which is to say, ignition within a few seconds. Problems with spark-type igniters, however, include among other things the electronic and physical noise produced by the spark.

With hot surface igniters, such as the silicon carbide hot surface igniter, the heating tip or element is resistively heated by electricity to the temperature required for the ignition of the fuel/air mixture, thus when the fuel/air mixture flows proximal to the igniter it is ignited. This process is repeated as and when needed to meet the particular operating requirements for the heating apparatus/appliance. Hot-surface-type igniters are advantageous in that they produce negligible noise in comparison to spark-type igniters. Hot surface-type igniters, however, can require significant ignition/warm-up time to resistively heat the resistance igniter sufficiently to a temperature that will ignite gas. In some applications, this warm-up time can vary between about 15 and about 45 seconds.

In recent years, efforts have been made to develop a robust, low-noise igniter that can ignite gas rapidly, which is to say within a few seconds. There is found in U.S. Pat. No. 4,925,386 a control system for electrical resistance-type igniters, and more specifically for tungsten heater elements embedded in a silicon nitride insulator. The relatively narrow temperature operating range of silicon nitride igniters necessitates such a control system. Indeed, the operating range of silicon nitride igniters must remain between the lowest temperature that will ignite gas and the temperature at which the igniter fails, i.e., the tungsten heater element breaks down.

Over time, this narrow range of operating temperatures is further narrowed due to a process referred to as "aging". As the tungsten heater elements are repeatedly heated to relatively high temperatures, the tungsten filaments oxidize or "age". Aging manifests as a cross-sectional change, i.e., decrease, in the tungsten filament. As a result, acceptable operating temperatures routinely decrease and continue to decrease with further aging. The described control system includes a microprocessor and a learning routine to control and modulate a solid-state switching means so that the igniter can be heated rapidly to and maintained at or near a suitable ignition temperature, which is below the maximum operating temperature. Moreover, the described learning routine maintains the temperature of the igniter just above the temperature needed to ignite the gas, to provide quick ignition, while continuously monitoring the maximum allowable temperature to prevent damage to the igniter.

Similarly, there is found in U.S. Pat. No. 5,725,368 a refined control system that controls the energizing of a silicon nitride igniter that, purportedly, enables ignition within approximately two seconds. The described control system includes a microcomputer in combination with a triac in series with an igniter and a learning routine. The microcomputer determines the level of power to be applied to the igniter as a function of the voltage available to energize the igniter and the resistance of the igniter. The triac delivers time-dependent power to the igniter using an irregular firing sequence.

There are, however, several shortcomings with these two control systems. First, they are drawn to a specific igniter type that is subject to "aging". As a result, the systems require hardware and software to enable the learning routine. They also continuously maintain the temperature of the igniter slightly above the minimum ignition temperature, e.g., about 1200 degrees Centigrade. Thus, it would be desirable to provide a robust control system for energizing a hot surface-type igniter of a type that is not susceptible to significant aging and does not have to maintain the igniter continuously at about 1200 degrees Centigrade.

SUMMARY OF THE INVENTION

The present invention features a control system for a hot-surface-type igniter, the control system comprising a control device that is configured and arranged to continuously monitor the line voltage to the system, to determine the time the full line voltage is to be applied to the hot-surface-type igniter as a function of the measured line voltage, and to regulate the voltage being applied to the electrical resistance igniter to another voltage level. The control system also includes a switching device that selectively controls the voltage being applied to the electrical resistance igniter responsive to signals from the control device. In a more particular embodiment, the another voltage level is the nominal operating voltage for the electrical resistance igniter.

In more particular embodiments, the control device comprises a microprocessor and the switching device comprises a thyristor or more particularly a triac. The microprocessor is any of a number of microprocessor is known to those skills in the art including a central processing unit (CPU), one or more memories, and an application program for execution in the CPU. In a more specific embodiment the one or more memories comprises two memories; one memory accessed by the CPU and the second nonvolatile type of memory for storing information such as look-up tables for determining and adjusting a duration for the "full-on" time and look-up tables for determining a duty cycle that delivers continuous voltage to the electrical resistance igniter based on the line voltage. In further embodiments, the CPU and the one or more memories are disposed on a single chip.

The thyristor or triac is operably coupled to the control device and the electric resistance igniter so as to be selectively controlled by the control device and so as to selectively control the voltage being applied to the electrical resistance igniter. In more particular embodiments, the thyristor or triac is controlled by the control device so that full line voltage is applied for a predetermined period of time and thereafter the control device controls the thyristor or triac so a voltage corresponding to another voltage level being applied. In a more specific embodiment, the control device controls the thyristor or triac by duty cycling the AC line voltage in half-wave cycle increments. In yet a more specific embodiment, the control device monitors the line voltage and regulates the voltage being applied so that a fairly constant voltage is applied to the electric resistance igniter.

According to another aspect of the present invention, there is featured a method of controlling energizing of one or more electrical resistance igniters. This method includes determining a line voltage; providing full line voltage to the electrical resistance igniter for a "full-on" time period; and regulating voltage to the electrical resistance igniter after expiration of the "full-on" time period. In a more particular embodiment the "full-on" time period is determined based on the line voltage to the system when the system is to energize the one or more electrical resistance igniters. Further, said regulating includes regulating the voltage so that a nominal operating voltage is applied to the electrical resistance igniter. In more specific embodiments, said regulating includes duty cycling AC line voltage in half-wave increments.

The control system and method of the present invention provide a robust control system and methodology for energizing one or more hot surface igniters of a type that is not susceptible to significant aging. Furthermore, the control system and method of the present invention provide a control system and methodology that do not maintain the igniter continuously at about an ignition temperature (e.g., 1200 degrees Centigrade) but rather resistively heat the one or more hot surface igniters using full line voltage for a predetermined period and thereafter regulates the input line voltage so that a voltage at another voltage level, a nominal operating voltage for the igniter, is applied.

Also featured is a heating apparatus, device or an appliance including an igniter control system according to the present invention. Such a heating apparatus, device or appliance further includes mechanisms for controlling and admitting combustion gas in proximity to the igniter.

Other aspects and embodiments of the invention are discussed below.

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein.

DETAILED DESCRIPTION OF THE INVENTION

Figure 1:
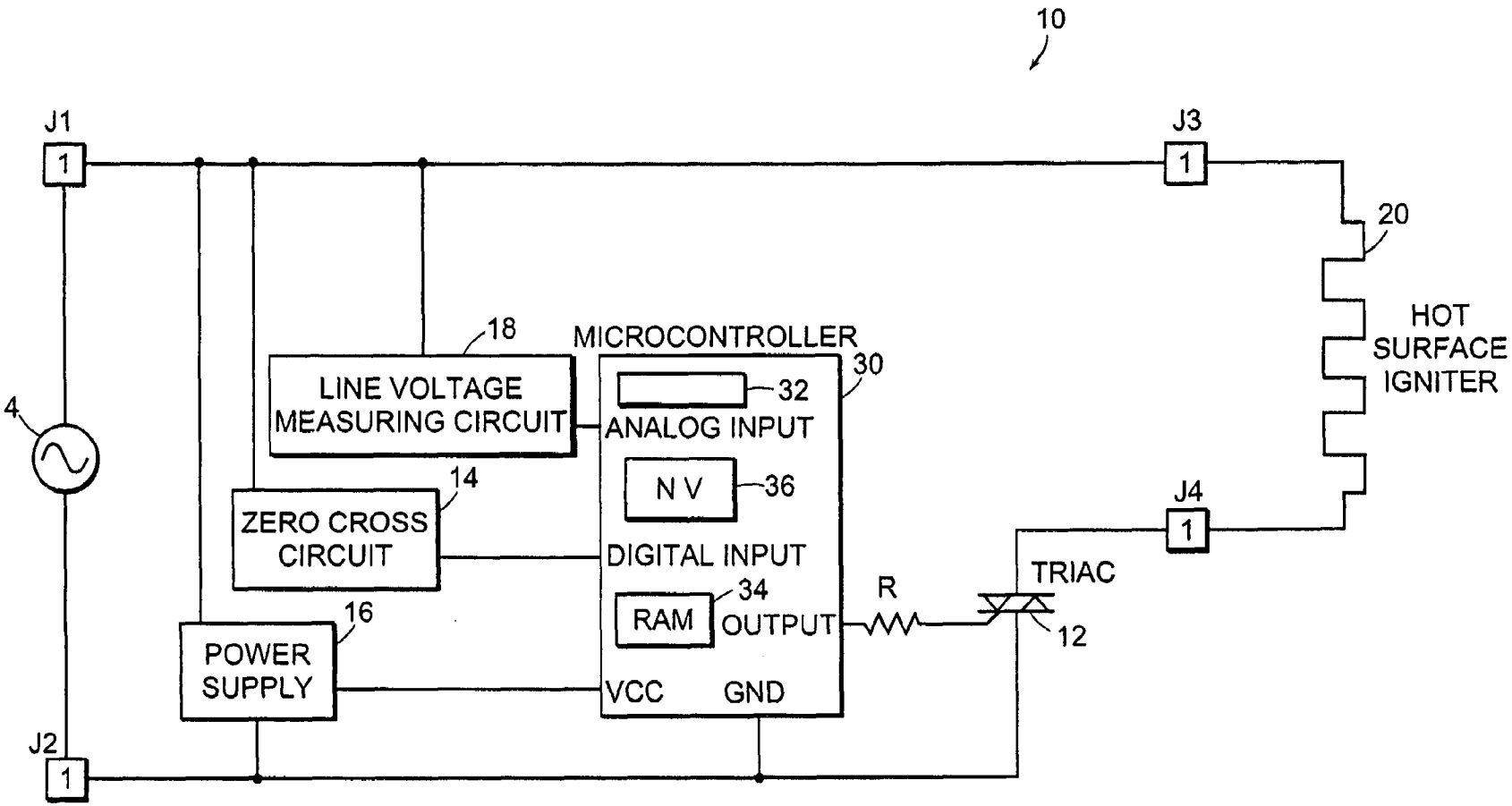
FIG. 1 is a schematic view of an illustrative embodiment of an igniter control system of a system in accordance with the present invention.

Referring now to the various figures of the drawing wherein like reference characters refer to like parts, there is shown in FIG. 1 a schematic view of an illustrative embodiment of an igniter control system 10 according to the present invention that is electrically connected to an electric surface igniter 20 and an electrical power source 4. The electric surface igniter 20 is any of a number of resistance hot surface igniters, more particularly ceramic type of electric surface igniters, known to those skilled in the art.

In a particularly illustrative embodiment, the igniter 20 is a ceramic/intermetallic hot surface igniter such as Norton Mini Igniters® manufactured by St. Gobain Industrial Ceramics Norton Igniter Products. Such an ignition device typically includes a heating element that extends outwardly from an end of the base which it is secured to. This shall be not limiting as the present invention can be used with other types of hot surface igniters as well as other types of ignition devices or igniters, such as for example Norton CRYSTAR Igniters®. In specific exemplary embodiments, the electric surface igniter 20 is an electrical resistance igniter having a nominal operating voltage of 18, 60, 70, 80, or 150 volt (V)AC, however, it should be recognized that the present invention is not particularly limited to these exemplary nominal operating voltages.

The power source 4 for the resistance hot surface igniter 20 and the control system 10 has sufficient capacity to heat-up the heating element of the igniter to the temperature required for ignition of the combustible mixture as well as for operation of the various functionalities of the control system. The electrical power source 4 is any of a number of sources of electrical power known to those skilled in the art. In an exemplary embodiment, the electrical power source 4 is the electrical wiring of the building or structure in which is located the heating device 100 (FIG. 3), which electrical wiring is interconnected via a fuse box or the equivalent to the electrical distribution system of an electrical utility. As indicated herein, the operating voltage of such an electrical distribution system can vary over a range of voltages as well as being dependent upon the country or region producing the power.

The control system 10 according to one aspect of the present invention is configured and arranged so as to control the operation, including the energizing, of the electric surface igniter 20. The control system 10 according to the present invention includes a thyristor 12, zero cross circuitry 14, a power supply 16, a line voltage measuring apparatus 18 and a microcontroller 30.

The zero cross circuitry 14 is electrically coupled to the power source 4 to monitor the line voltage from the power source and is operably coupled to the microcontroller 30. The zero cross circuitry 14 is any of a number circuits known to those skilled in the art that is configured and arranged so as to be capable of detecting or determining when the AC line voltage crosses the time axis, in other words passes through zero voltage. The zero cross circuitry 14 also is configured and arranged so as to provide an output signal to the microcontroller 30 when the AC line voltage passes through zero voltage. In an exemplary embodiment, the output signals are digital signals.

Power supply 16 is electrically coupled to the power source 4 and to the microcontroller 30. The power supply 16 is any of a number of power sources known to those skilled in the art configured and arranged to provide the appropriate voltage and current required for operation of the microcontroller 30. In an exemplary embodiment, the power supply 16 includes a series connected capacitor and zeiner diode that steps the line voltage down to the operating voltage of the microcontroller 30.

The line voltage measuring apparatus 18 is electrically coupled to the power source 4 and is operably coupled to the microcontroller 30. The line voltage measuring apparatus 18 includes any of a number of line voltage measuring circuits known to those skilled in the art that is configured and arranged to monitor and determine the line voltage from the power source 4 and to provide output signals representative of the determined line voltage. More particularly, such circuits are configured and arranged so as to be capable of quickly determining the line voltage and providing such output signals to the microcontroller 30. In a more particular embodiment, the line voltage measuring apparatus 18 comprises a conventional resistor divider filter circuit. In an exemplary embodiment, the output signals are analog signals, however, the circuitry can be configured so as to provide digital output signals.

The microcontroller 30 includes a processing unit 32, random access memory 34, a nonvolatile memory 36 and an applications program for execution in the processing unit. The applications program includes instructions and criteria for receiving and processing the various signals being inputted to the microcontroller 30 from the line voltage measuring apparatus 18 and the zero cross circuit 14 and to provide output control signals to the thyristor 12, thereby controlling the energizing of the hot surface igniter 20. The applications program, including instructions and criteria thereof, is discussed below in connection with FIGS. 2-3.

The processing unit 32 is any of a number of microprocessors known to those skilled in the art for performing functions described herein and operating in the intended environment. In an exemplary embodiment, the processing unit 32 is Samsung S3C9444 or Microchip 12C671. The random access memory (RAM) 34 and the nonvolatile memory 36 is any of a number of such memory devices, memory chips, or the like as is known to those skilled in the art. The nonvolatile memory 36 more particularly can comprise either flash or spindle type of memory. In more particular illustrative embodiments, the nonvolatile memory 36 includes nonvolatile random access memory (NVRAM), read-only memory (ROM) such as EPROM. In a particular embodiment, the processing unit 32, RAM 34 and nonvolatile memory 36 are disposed/arranged so as to be co-located on a single integrated chip. This is not particularly limiting as these components can be configured and arranged in any of a number of ways known to those skilled in the art.

The thyristor 12 is a rectifier which blocks current in both the forward and reverse directions. In a more specific embodiment, the thyristor 12 is a triac as is known to those skilled in the art that blocks current in either direction until it receives a gate pulse from the microcontroller 30. Upon receiving the gate pulse, current flows through the triac. The thyristor 12 or triac is electrically coupled to the power source 4 and the hot surface igniter 20 so as to control the flow of current from the power source through the hot surface igniter. Thus, in the case where the thyristor 12 or triac is blocking current flow, the hot surface igniter 20 is de-energized. In the case where the thyristor 12 or triac has received a gate pulse, current flows through the hot surface igniter 20 thereby energizing the igniter and causing it to be heated.

Figure 2:
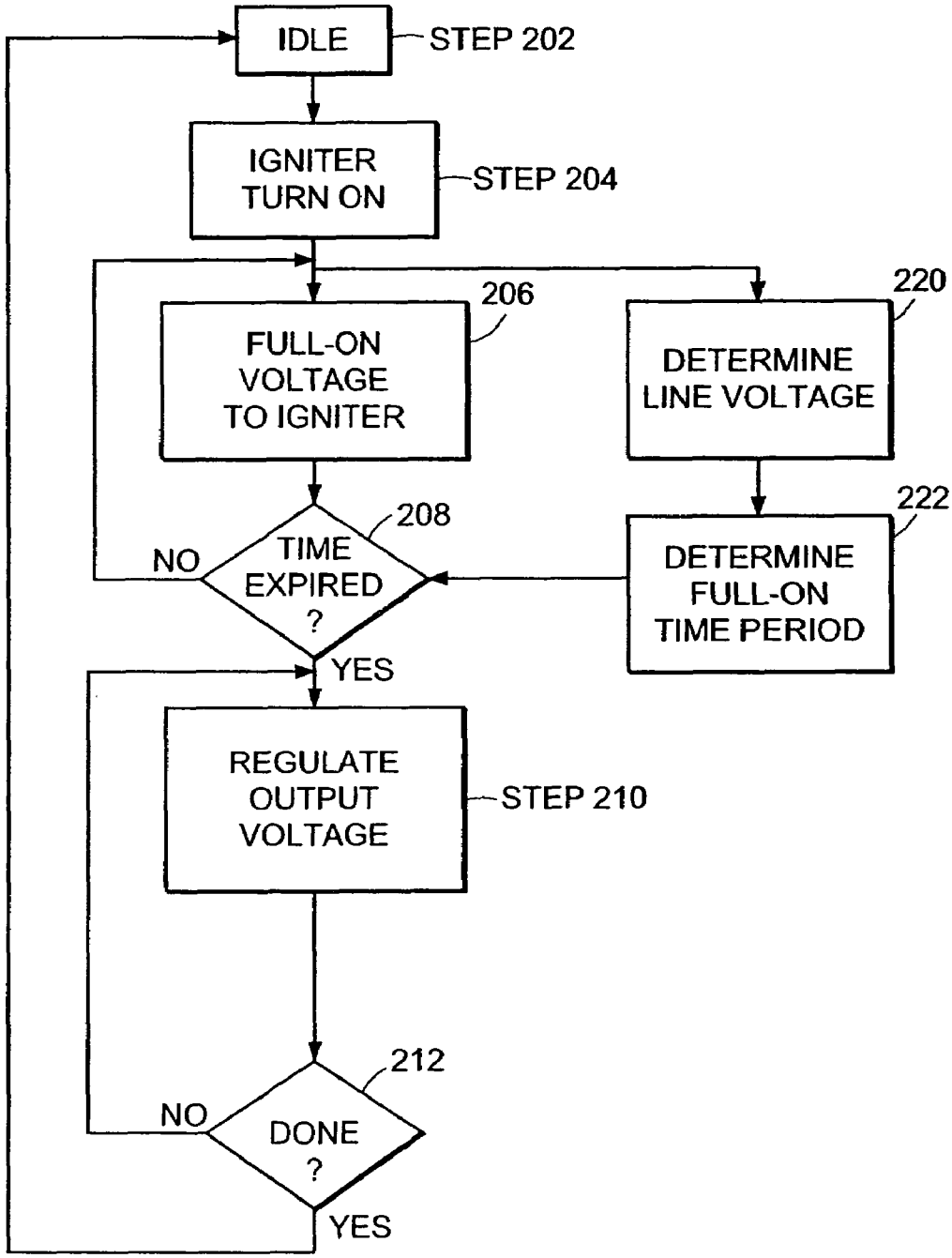
FIG. 2 is a flow diagram illustrating one embodiment of a method of energizing an igniter in accordance with the present invention.

The operation of the igniter control system 10 is best understood from the following discussion and with reference to FIG. 2. Reference also should be made to FIG. 1 and the foregoing discussion for features and functionalities of the control system not otherwise provided or discussed hereinafter. As noted above, the following also describes the functions as well as the instructions and criteria of the applications program being executed in the processor 32 of the microcontroller 30.

Figure 3:
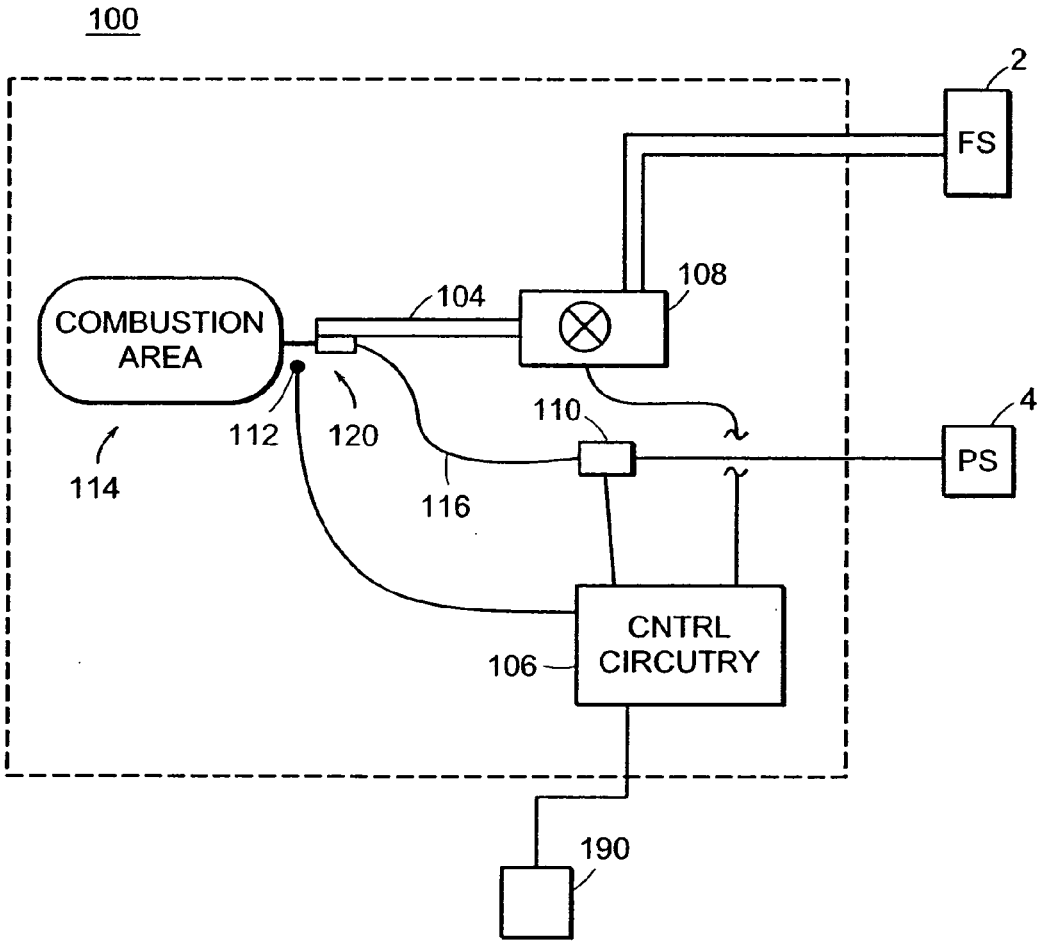
FIG. 3 is a simplified schematic view of an appliance or heating apparatus having an igniter and igniter control system in accordance with the present invention.

As more particularly described below in connection with FIG. 3, the igniter control system 10 is operated so the hot surface igniter 20 is de-energized during those times when heat energy is not to be produced by the appliance or heating device 100 (FIG. 3). As such, during such time non-heat producing times the igniter control system 10 is in an idle state, step 202. In a more particular embodiment, the igniter control system 10 is configured and arranged so as to power down when in the idle state. When heat energy is to be produced by the appliance or heating device 100, an input signal is provided to the microcontroller 30 of the igniter control system 10, such a signal corresponds to a signal to energize the one or more hot surface igniters 20 of the heating device, step 204. Alternatively, in the case where the igniter control system 10 is powered down in the idle state, such a signal can be manifested by restoring power to the control system.

Following receipt of this signal, the microcontroller 30 outputs a signal (e.g., a gate pulse) to the triac or thyristor 12 to fire the thyristor so that current from the power source 4 flows through the one or more hot surface igniters 20. More particularly, the microcontroller 30 controls the triac or thyristor 12 so that such current flows continuously and so "full-on" voltage is supplied to the hot surface igniter(s) 20, step 206. This typically produces an "over voltage" condition, that is the voltage developed across the hot surface igniter(s) 20 is more than nominal operating voltage for the igniter(s). Consequently, the hot surface igniter(s) 20 heat faster to a given temperature and also will produce more heat energy in the igniter(s).

As indicated above, the line voltage measuring apparatus 18 monitors the line voltage of the power source 4 and provides output signals representative of the line voltage to the microcontroller. After receiving such an energizing signal, the microcontroller 30 processes the output signals from the line voltage measuring apparatus 18 to determine the amplitude of the line voltage, step 220. In the United States where the specified line voltage is 220 VAC, the nominal line voltage typically ranges between about 208 VAC and about 240 VAC. In Europe and other parts of the world where the specified line voltage is 230 VAC, the nominal line voltage typically ranges between about 220 VAC and about 240 VAC. Thus, line voltage variance universally can range anywhere between about 176 VAC and about 264 VAC. In the United States, there are cases where other nominal line voltages are found; in one case the nominal line voltage is 110 VAC, which ranges between 102 VAC and 132 VAC and in another case the nominal line voltage is 24 VAC, which ranges between 20 VAC and 26 VAC.

The microcontroller 30 evaluates the determined or measured line voltage to determine the time period during which the "full-line" voltage is to be applied or delivered to the hot surface igniter(s) 20, step 222. This time period is hereinafter referred to as the "full-on" time period. More particularly, the processor 32 compares the determined line voltage with a look-up table to determine the "full-on" time period appropriate for the determined line voltage. In more specific embodiment, the look-up table is stored in the nonvolatile memory 36. In an exemplary embodiment, this process of determining the "full-on" time period is completed within about a second after the signal to energize the igniter is received by the microcontroller 30.

Consequently, the processor 32 adjusts the "full-on" time period each time the microcontroller 30 receives an input signal to energize the hot surface igniter(s) 20 based on the line voltage being measured each time. In other words, the time the "full-on" voltage will be applied or delivered to the hot surface igniter(s) 20 will vary depending upon the line voltage being measured each time the igniter(s) is to be energized. For example, if the measured voltage is at the lower-end of a given voltage range, then the "full-on" time period would be adjusted to compensate for this by applying the "full-on" voltage for a longer period of time. Similarly, if the measured voltage is at the higher-end of a given voltage range voltage, then the "full-on" time period would be adjusted to compensate for this by applying the "full-on" voltage for relatively shorter time than that for the low-end line voltage.

After determining the "full-on" time period, the processor 32 continuously determines if this time has expired, step 208. If it is determined that the time period has not expired (NO, step 208), then microcontroller 30, more particularly the processor 32, controls the triac or thyristor 12 so that the "full-on" voltage continues to be applied or delivered to the hot surface igniter(s) 20, step 206. If it is determined that the time period has expired (YES, step 224), then the processor 32 controls the triac or thyristor 12 to regulate the voltage being applied to the triac or thyristor, step 210.

After the "full-on" voltage time has expired (YES, step 208), the microprocessor 32 controls the triac or thyristor 12 to regulate the voltage being applied or delivered to the hot surface igniter(s) 20 to maintain the voltage about the nominal operating voltage for the igniter. In an exemplary embodiment, the microprocessor 32 controls the triac or thyristor 12 so as to regulate the voltage being applied by duty cycling the AC line voltage in half-wave cycle increments. More particularly, the microprocessor 32 uses the output signals from the zero cross circuitry 14 to control the operation of the triac or thyristor 12 in these half-wave cycle increments. In more specific embodiments, the regulation method being implemented by the microprocessor 32 regulates the voltage being applied by duty cycling the AC line voltage in half-wave cycle increments with a period of about 50 half-wave cycles that are divided further into sub-periods of about 5 half-wave cycles each to minimize flickering.

The following example illustrates the application of this regulation method in the case where a nominal voltage of 150 VAC is applied to the hot surface igniter(s) 20. If it is determined that 32 out of the 50 half-wave cycles are needed to regulate the voltage being applied so as to maintain a 150 VAC nominal voltage, then the half-cylces will be distributed in the sub-periods as follows: eight of the 10 sub-periods in the duty cycle would have three half-wave cycles (8×3=24) and the remaining two sub-periods would have four half-wave cycles (2×4=8). Assuming that the two sub-periods with four half-wave cycles are the first and second sub-periods (SP-1 and SP-2, respectively), the microprocessor 16 regulates output voltage to the hot surface igniter(s) 20 by turning on the triac or thyristor 12 for four half-wave cycles and turning it off for one half-wave cycle during the first sub-period (SP-1); turning it on for another four half-wave cycles (SP-2); turning it off for one half-wave cycle; turning it on for three half-wave cycles (SP-3); and so forth to the tenth sub-period (SP-10).

In more particular embodiments, the nonvolatile memory 36 further includes a second look-up table that associates line voltage from the power source with the number of half-wave cycles needed to regulate the voltage being applied to the hot surface igniter 20 so the voltage being applied is maintained at or about the nominal operating voltage for the igniter. Those skilled in the art can appreciate that the period of the half-wave cycle, the number of sub-periods, and/or the number of half-wave cycles per sub-period can be modified from that described herein and such modification is within the scope and spirit of the present invention.

In further embodiments, the microcontroller 30 evaluates the determined or measured line voltage and periodically make adjustments to the duty cycle so that the voltage being applied to the hot surface igniter 20 is maintained so that the hot surface igniter maintains a fairly consistent temperature. More particularly, the microprocessor 32 compares the newly determined or measured line voltage with the second look-up table and determines the number of half-wave cycles needed to regulate the voltage being applied to the hot surface igniter 20 so the voltage being applied is maintained at or about the nominal operating voltage for the igniter.

The microprocessor 32 continuously determines if the energization cycle of the hot surface igniter 20 is complete or done, step 212. Typically, the microprocessor 32 receives an input signal from an external sensor or switch indicating that the heating process should be terminated or that a stable combustion process has been established within a heating device such that an ignition source is no longer required. If it is determined that the energization cycle is complete (YES, step 212), then the microprocessor 32 provides the appropriate outputs that block current flow through the triac or thyristor 12 and determines to control system to the idle condition (step 202). If it is determined that the energization cycle is not complete (NO, step 212), then the microprocessor 32 continues to regulate the voltage being applied to the hot surface igniter (step 210).

The igniter control system 10 according to the present invention yields a control system that allows a hot surface igniter(s) 20 to be heated up more quickly and thus shorten the ignition time for the heating device or apparatus. This control system, after a predetermined time period has expired, also reduces and regulates the voltage being applied thereafter so the hot surface igniter maintains a fairly consistent operating temperature and so as to not unduly shorten the operational life of the hot surface igniter(s). In further embodiments, the methodology for regulating the voltage also yields a method that provides the least amount of electrical emissions, such that a line filter may not be provided, thereby reducing hardware requirements as well as associated costs such as for manufacturing.

Now referring to FIG. 3, there is shown a simplified schematic view of a heating device 100, comprising one of an appliance or a heating apparatus, having a hot surface igniter 20 and a igniter control system 10 in accordance with the methodology and devices of the present invention. The heating device 100 being illustrated is described hereinafter as being used with a gaseous hydrocarbon (such as natural gas, propane) as the material to be combusted therein to produce the heat energy. This shall not be construed as a limitation as the materials used for combustion are not limited to gaseous hydrocarbons but also include combustible liquid hydrocarbons and other gases (e.g., hydrogen) and liquids that continuously combust once they are ignited.

Such a heating device includes an igniter device 20, a burner tube 104, device control circuitry 106, a fuel admission valve 108 and an igniter control system 10. The device control circuitry 106 is electrically interconnected to the fuel admission valve 108 and the igniter control system so as each can be selectively operated to produce heat energy as hereinafter described. The fuel admission valve 108 is fluidly interconnected using piping or tubing to a source 2 of a combustible material as the fuel for the heating device 100. In the illustrated embodiment, the piping or tubing is interconnected to a source of a gaseous hydrocarbon such as natural gas or propane. The fuel source can be one of an external tank or an underground natural gas piping system as is known to those skilled in the art.

The control circuitry 106 is electrical interconnected to an external switch device 190 that provides the appropriate signals to the control circuitry for appropriate operation of the heating device 100. For example, if the heating device 100 is a furnace to heat a building structure or a hot water heater then the external switch device 190 is a thermostat as is known to those skilled in the art that senses a bulk temperature within the building structure or the hot water in the tank. Based on the sensed temperatures the thermostat outputs signals to the control circuitry 106 to turn the furnace or hot water is heater on and off. If the heating device 100 is a heating appliance such as a stove, then the external switch device 190 typically is a mechanical and/or electronic type of switch. The switch outputs signals to the control device by which a user can turn the heating device 100 (e.g. stove burner, oven) on and off and also regulate or adjust the amount of heat energy to be developed by the heating device.

In use, the control circuitry 106 receives a signal from the eternal switch device 190 calling for the heating device 100 (e.g., stove burner, oven, hot water heater, furnace, etc) to be turned on. In response to such a signal, the control circuitry 106 provides a signal to the igniter control system 10 to energize the hot surface igniter 20, and thereby cause electricity to flow through the heating element of the igniter 20 to heat the heating element to the desired temperatures for causing a fuel/air mixture to ignite. These processes for energizing and heating of the igniter is as described above in connection with FIG. 2. After the igniter heating element is heated to the desired temperature, the control circuitry 106 actuates the fuel admission valve 108 so that fuel flows through the burner tube 104 to the igniter heating element. As is known in the art, air is mixed with the fuel that is presented to the igniter heating element so that a combustible mixture is thereby created and ignited by the igniter heating element. This ignited fuel/air mixture is passed to the combustion area 114 so that useable heat energy can be extracted and used for the intended purpose of the heating device (e.g., to heat food or water). Although a single burner tube 104 is illustrated, and as is known to those skilled in the art, the heating device 100 can be configured with a plurality or a multiplicity or more of burner tubes to generate a desired heat output and with one or more fuel admission valves 108. Typically, however, one of the plurality or multiplicity or more of burner tubes is arranged with hot surface igniter 20.

A sensor 112 is typically located proximal the hot surface igniter for use in determining the presence of continuous combustion of the fuel/air mixture. In one embodiment, the sensor 112 is a thermopile type of sensor that senses the temperature of the area in which the fuel/air mixture is being combusted. In another embodiment, the sensor 112 is configured and arranged so as to embody the flame rectification method or technique. The sensor 112 is interconnected to the control circuitry 106 so that if the sensor does not output, for example, a signal to the control circuitry indicating the safe and continuous ignition of the fuel/air mixture within a preset period of time, the control circuitry shuts the fuel admission valve 108. As is known to those skilled in the art, in certain applications the control circuitry 106 also can be configured and arranged to repeat this attempt to ignite the fuel/air mixture to start the heating process for the heating device 100 or appliance one or more times. Typically, the electrical power to the hot surface igniter 20 also is terminated in such cases.

When the heating function is completed, the control circuitry 106 again receives a signal from the external switch device 190 calling for the heating device to be turned off. In response to such a signal, the control circuitry 106 closes the fuel admission valve 108 to cut off the flow of fuel, thereby stopping the combustion process. In addition, and as indicated above, the igniter control system would be placed in the idle or standby condition (step 202, FIG. 2) at least one heating function is completed.

Although a number of embodiments of the present invention have been described, it will become obvious to those of ordinary skill in the art that other embodiments to and/or modifications, combinations, and substitutions of the present invention are possible, all of which are within the scope and spirit of the disclosed invention.

What is claimed is:

1. A control system to control energizing one or more electrical resistance igniters from an electrical power source, the control system comprising:

a control device configured and arranged to control application of a voltage to the one or more electrical resistance igniters; and a voltage measuring device, the voltage measuring device being operably coupled to the electrical power source so as to measure an output voltage of the power source and being operably coupled to the control device so as to provide an output of the measured output voltage to the control device;

wherein the voltage being applied initially is a first voltage, so the first voltage is applied for a full-on time period and thereafter the average voltage being applied is a second voltage lower than the first voltage, and the first voltage is applied at a level whereby voltage developed across the one or more igniters is more than the nominal operating voltage of the one or more igniters, and the second voltage maintains the one or more igniters at or above ignition temperature, wherein the control device is configured and arranged to determine the full-on time period based on the measured output voltage.

2. The control system of claim 1 wherein the control device is configured and arranged to selectively operate a switch so as to regulate the second voltage.

3. The control system of claim 2 wherein the switch is a triac.

4. The control system of claim 1 further comprising one or more ceramic resistance igniters associated with the control device.

5. A control system to control energizing one or more electrical resistance igniters from an electrical power source, the control system comprising:

a switch operably connected between the electrical power source and the one or more electrical resistance igniters;

a control device operably coupled to the switch;

a voltage measuring device operably coupled to the electrical power source so as to measure an output voltage of the power source and being operably coupled to the control device so as to provide an output of the measured output voltage to the control device;

wherein the control device is configured and arranged to selectively control the switch and thereby the application of a voltage to the one or more electrical resistance igniters; and wherein the control device is configured and arranged so that the voltage being applied initially is a first voltage, so the first voltage is applied for a full-on time period and thereafter the average voltage being applied is a second voltage lower than the first voltage, and the first voltage is applied at a level whereby voltage developed across the one or more igniters is more than the nominal operating voltage of the one or more igniters, and the second voltage maintains the one or more igniters at or above ignition temperature, and wherein the control device is configured and arranged to determine the full-on time period based on the measured output voltage.

6. The control system of claim 5 wherein the control device is configured and arranged so as to provide a fairly constant voltage as the second voltage.

7. The control system of claim 5 wherein the control device is configured and arranged to regulate the second voltage so as to provide a fairly constant voltage based on the measured output voltage.

8. The control system of claim 5 further comprising a storage device in which is stored a multiplicity of time period values and related output voltages; and wherein the control device is configured and arranged to select one of the stored multiplicity of time period values as the full-on time period based on the measured output voltage.

9. The control system of claim 5 wherein the control device is configured and arranged to selectively operate the switch so as to regulate the second voltage.

10. The control system of claim 5 wherein the switch is triac.

11. The control system of claim 10 wherein the control device is configured and arranged to selectively operate to the triac so as to regulate the second voltage by duty cycling the power source output voltage in half-wave cycle increments.

12. The control system of claim 5 wherein the control device includes a microprocessor and in an applications program for execution in the microprocessor, the applications program including instructions and criteria for controlling the functionality of the control device and the switch.

13. A method for controlling energizing an electrical resistance igniter connected to a power source, the controlling method comprising the steps of:

applying a first voltage from the power source to the electric resistance igniter for a full-on time period, the first voltage being applied at a level whereby voltage developed across the one or more igniters is more than the nominal operating voltage of the one or more igniters, wherein said step of applying the first voltage for a full-on time period further comprises measuring output voltage of the power source and determining the full-on time period based on the measured output voltage; and applying a second voltage lower than the first voltage to the electric resistance igniter, wherein the second voltage maintains the igniters at or above ignition temperature.

14. The method of claim 13 wherein said measuring is performed when line voltage is initially applied to the electric resistance igniter.

15. The method of claim 13 wherein said determining the full-on time period based includes selecting one of a multiplicity of time period values as the full-on time period based on the measured output voltage.

16. The method of claim 15 wherein said measuring is performed when line voltage is initially applied to the electric resistance igniter.

17. The method of claim 13 wherein the electric resistance igniter is a ceramic igniter.

* * * * *